United States Patent [19]

Bernt

[11] 4,172,701

[45] Oct. 30, 1979

[54] MEANS FOR MOUNTING INTERNAL KILN HARDWARE

[76] Inventor: Jorgen O. Bernt, 1357 Amber Crescent, Oakville, Ontario, Canada

[21] Appl. No.: 883,176

[22] Filed: Mar. 3, 1978

[30] Foreign Application Priority Data

Mar. 10, 1977 [GB] United Kingdom ..... 10130/77

[51] Int. Cl.[2] ..... F27B 7/14

[52] U.S. Cl. ..... 432/118; 59/86; 241/183; 432/103; 34/135

[58] Field of Search ..... 432/103, 118, 119; 59/86; 51/164; 241/181, 183; 366/225, 228; 34/130, 135

[56] References Cited

U.S. PATENT DOCUMENTS

| | | | |
|---|---|---|---|
| 3,124,338 | 3/1964 | Harris | 432/118 |
| 3,494,124 | 2/1970 | Howell, Jr. | 59/86 |
| 3,526,394 | 9/1970 | Howell, Jr. | 59/86 |
| 3,780,447 | 12/1973 | Fales | 432/118 |
| 3,802,634 | 4/1974 | Mix | 241/183 |
| 3,869,247 | 3/1975 | Deussner | 432/118 |
| 4,071,962 | 2/1978 | Saeman | 432/118 |

*Primary Examiner*—Henry C. Yuen

[57] ABSTRACT

A mounting device for kiln hardware comprises two standards connected to the kiln wall and projecting inwardly through the refractory. One standard is connectable to the hardware through a removable pin. The hardware and the other standard are provided with cooperating means which prevent rotation of the hardware about the pin when the pin is installed. The members are designed so that removal of the pin allows removal and replacement of the hardware.

3 Claims, 6 Drawing Figures

MEANS FOR MOUNTING INTERNAL KILN HARDWARE

This invention relates to means for mounting lifters or other devices for use with long rotary sloping cylindrical devices of the kiln type including such devices as cement kilns, lime kilns, roasters, dryers, coolers, calciners and the like. In this application "Kiln" is used to include any of the above devices.

In such devices, it is sometimes desireable to have lifters to raise particulate material from the bed of the kiln and drop it at some height above the bed during the rotation of the kiln to cause agitation of the particles in the gas flowing through the kiln or the fall of the particles through such gas.

Other devices are rigidly mounted in kilns including dams which extend inwardly from the kiln walls and circumferentially inward about a portion of the kiln to regulate the flow of particulate material down the kiln.

Prior lifters and other devices for such kilns have suffered from the disadvantage that, with the mounting means employed, they were difficult to replace. In fact such replacement frequently required dismantling or partial dismantling of the refractory lining for the kiln. Since the lifters or other device tended to wear out before the lining, the dismantling and replacement of a part of the refractory lining was an undesireable expense. It is desireable to support the lifter or device in a manner which allows its easy replacement without interference with the kiln shell and lining.

Accordingly, in accord with the invention, a pair of metal standards are provided for support of the metal lifter or other device with the standards designed to be attached to the metal shell of the kiln and to project radially inwardly a sufficient distance to project through the refractory lining, a first one of these standards and the lifter or other device being designed to be connected by a pivot pin whereby the lifter or other device may be attached thereto by a pin and the other standard is provided with surfaces which will interact with complementary shaping on the lifter or other device, to prevent its rotation about the pivot pin. Thus when it is desired to replace the lifter member or other device, the pin may be withdrawn and the lifter may be withdrawn from the surfaces provided on the second standard and the lifter or other replaced by the reverse of the above procedures. The shaping of the standards on the one hand and of the lifter, or other device on the other hand, being shaped to allow removal and replacement of the lifter or device on the standards when the pin is removed. The pairs of standards, being the combination of the pivot pin mounting standard and the rotation preventing standard, are repeated along the length of each lifter as support for the lifter requires. Such pairs of standards are repeated about the shell to allow the provision of the number of lifters required.

In drawings which illustrate a preferred embodiment of the invention:

Figure 1:
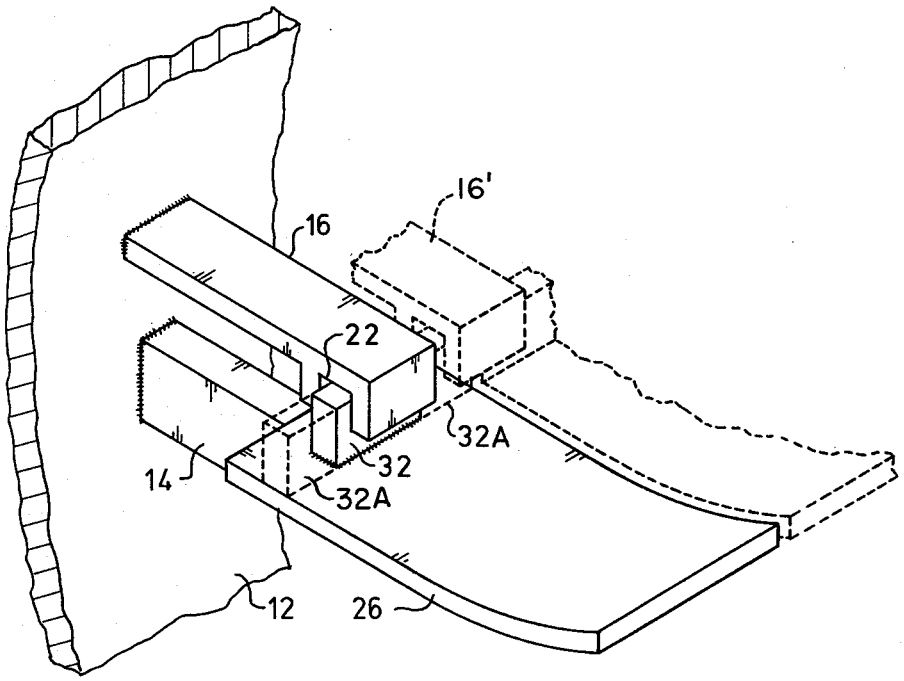
FIG. 1 shows a front view of a lifter in accord with the invention, with the refractory lining of the kiln not shown.

In the drawings, the cross-section of a kiln 10 shows the shell wall 12 having a standard 14 of metal, welded (or otherwise permanently attached) thereto and projecting inwardly sufficiently to have an aperture 18 for a pin 20 with the aperture and pin located inwardly of the refractory lining 24. The pin axis is preferably substantially but not necessarily parallel to the kiln axis. Spaced circumferentially a short distance from the standard 14 is a second standard 16 also welded to the shell wall 12 and extending radially inwardly past the level of the refractory lining 24 to mount members defining a groove 22 extending preferably longitudinally of the kiln but in any event approximately parallel to the axis of pin 20. Groove 22 is oriented to face the pivot pin 20 on the first hanger. Although the drawing shows one pair of arms per lifter, two or more pairs of arms may be provided if the lifter is sufficiently long. The lifter 26 as shown in the drawing comprises a shelf like plate bent to form a curve towards and at its free end of approximately 30° and therefore defining a concave and a convex side. On the convex side the lifter is provided at locations corresponding to the location of the standards with ears 28 defining apertures corresponding to and for alignment with apertures 18 so that the pivot pin 20 may be inserted in the aligned apertures 18 and 30 to attach an ear 16 to a first arm 14. On the concave side of lifter 26, a ridge 32 is provided running longitudinally along the lifter 26 complementary to and located to be received within groove 22 when the lifter 26 is at its desired attitude relative to the kiln walls and a pin is inserted through aligned apertures 18 and 30.

The pin 20 may be fixed in place by any conventional means which allows retention of the pin during use of the lifter 26 and relatively easy removal when the lifter is to be replaced. We prefer to use for pin retention and removal pin and retainer constructions such as those shown in U.S. Pat. No. 3,958,411 dated May 25, 1976 to Jorgen O. Bernt. However for the purpose of this invention any conventional pin arrangement may also be used.

It will be obvious that the construction allows easy replacement of a worn lifter 26 without interference with refractory lining 24. A lifter 26 is replaced by first removing the pins 20 from the aligned apertures 18 and 30 whereby all the ears 28 of a lifter are detached from the first arms 14. The worn lifter 26 may then be lifted out with the ridges 32 sliding out of grooves 22. A new lifter 26 is installed by first sliding the ridges 32 of the lifter into the grooves 32 and than aligning the apertures 30 on the new lifter with the corresponding apertures 18 on the first arms 14 and re-installing the pins 20 so that the new lifter is firmly retained in place. (The fit of each ridge 32 in each groove 22 is made loose enough so that, in installing the lifter, the ridge may first be inserted into the groove, with the ears and bores misaligned and then the ears of the lifter pivoted, with the ridge in the groove, until the lifter ears bracket standard 14 and the apertures 18 and 30 are aligned for reinsertion of the pin).

It will be obvious that with the illustrated method of stopping rotation of the lifter, the groove and ridge may be reversed, that is that the groove may be defined on the lifter and the cooperating ridge defined on the second arms 16. It will also be obvious that any other rotation stop surfaces may be used, within the scope of the invention, which uses cooperating members on the second arms 16 and the lifter to prevent rotation of the lifter in either direction about the pivot pin but sliding removal or insertion of the lifter from or into the rotation stop surfaces when the pin has been removed.

Although the lifter 26 is shown with an upturned end to allow distribution of material across the upper quadrant of a kiln, the invention herein is not limited to the shape of the lifter, which may have any contour suitable to its specific application.

Figure 2:
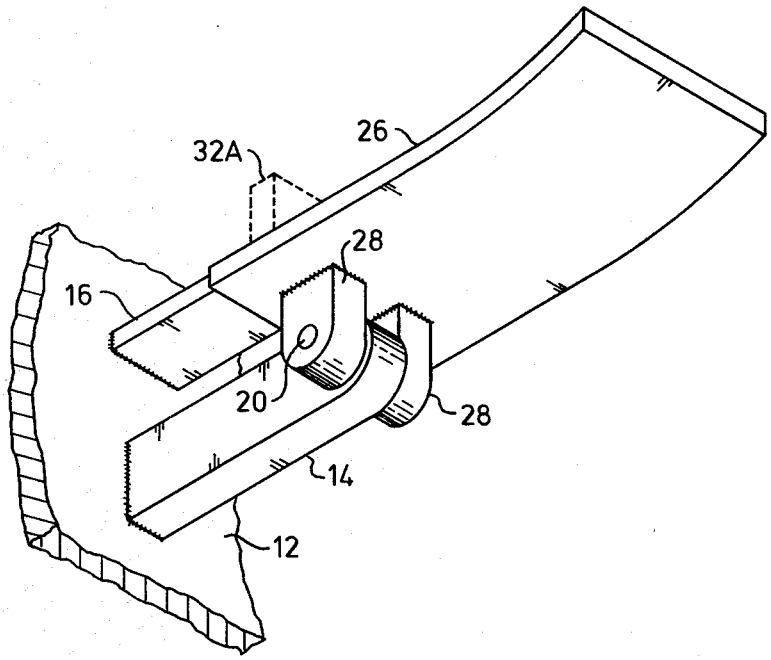
FIG. 2 shows a rear view of the above.
Figure 3:
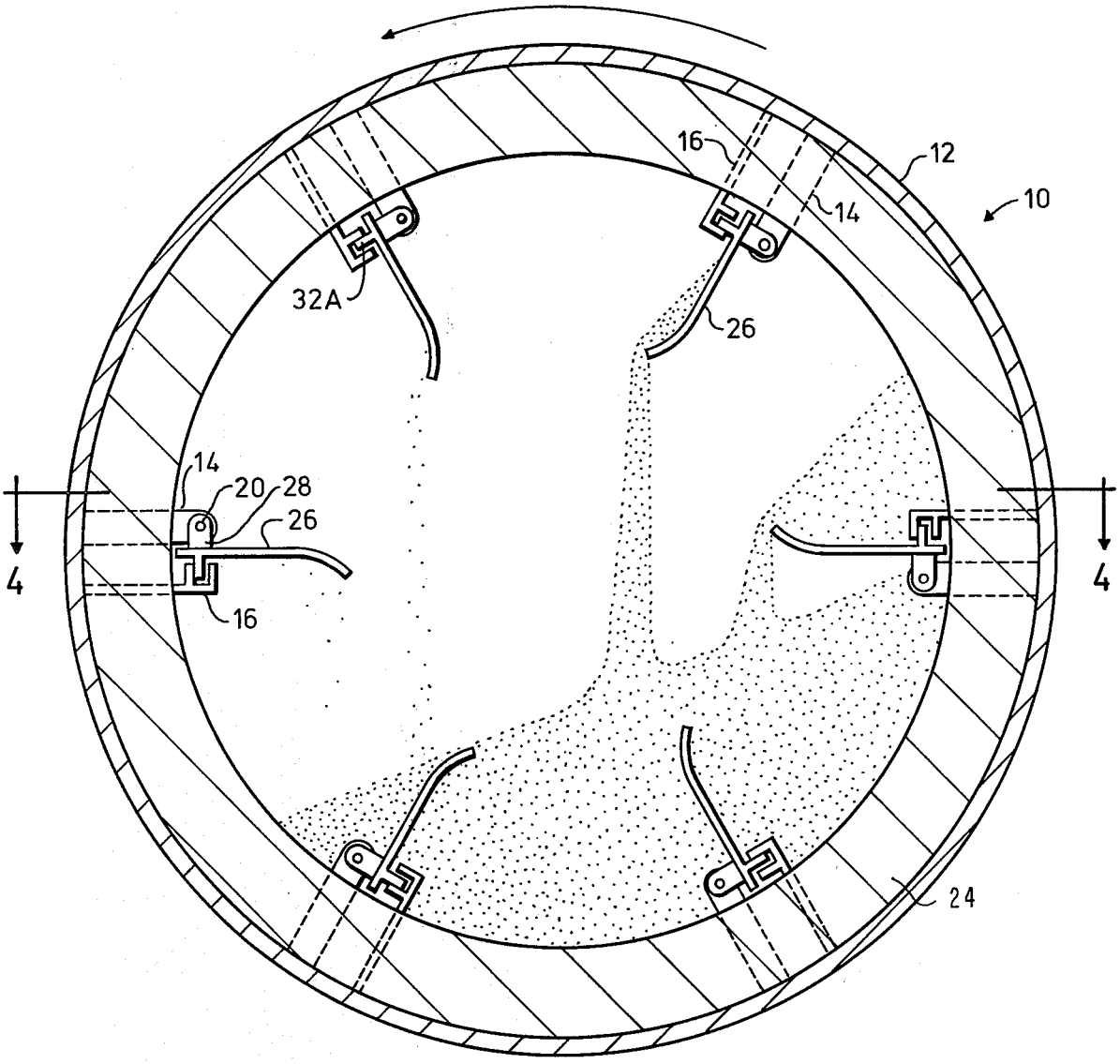
FIG. 3 shows a cross-section of a kiln with the lifters installed.
Figure 4:
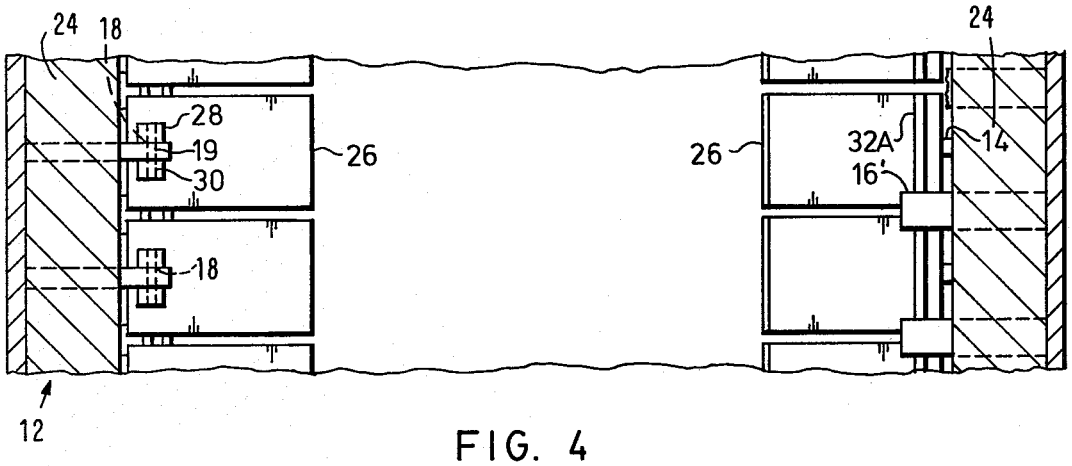
FIG. 4 shows a view along the line 4—4 of FIG. 3.

In many applications it is preferable to have the standards 16 and the grooves defined thereby opposite the space between adjacent plates 26, instead of opposite standards 14 as shown in FIGS. 1 and 2. Placing the standards 16 and the grooves 22 defined thereby opposite the spaces between plates 26 is shown (as standard 16') in dotted form on FIG. 1. With this alternative arrangement a groove 22 receives parts of the ridges 32A of two adjacent plates 26 so that the ridges 32–32A are extended to each edge of the plate 26' as also indicated in FIG. 1. This alternative arrangement is illustrated in FIG. 4.

It is noted that, with the construction shown, it is not necessary that the number of standards 16 correspond to the number of lifters. Thus a standard 16 may have an extent as shown that its groove 22 will receive the ridges 32 of more than one lifter, conversely a ridge 32 might as shown cooperate with more than one standard 16. The members 16 and their grooves 22 might be staggered with respect to the lifters so that the ridges 32 of two lifters contacted ends of the groove 22. In any of the above alternatives the ridge 32 may be extended to the edge of the lifter, as indicated by the dotted extensions thereof designated 32A.

The advantages of the invention include the fact that the inventive structure provides very low heat transfer paths from the lifters to the outside of the kiln. For example, with the structure as shown in the drawings the only high heat conduction paths from lifters 26 being through pin 20 and standard 14 or through members 32, 22 and 16. These are paths of far less heat flow capacity than exist in the prior art construction where the lifters are welded or massively attached to the shell.

Moreover it is easy, with the invention, to replace worn lifters without replacing the lifter mounts.

Moreover the use of a plurality of lifters in a row, as shown and described, allows the easy replacement of some without replacing all in contrast to the prior art where a lifter running the length of the kiln might have to be replaced because of damage to one part.

Moreover the use of a plurality of lifters in a row, as shown and described, allows the use of different qualities of lifter in a single row, using ordinary quality lifters in low wear areas and lifters of a high wear alloy in heavy wear areas.

The invention comprising the standards 14 and 16 mounted on the kiln wall 12, extending through the refractory and the mounting means comprising the aligned ears on one side and the cooperating groove and ridge on the other side may be used for other kiln devices than lifters. With each of such other devices, the device if worn or damaged or for any other reason, may be replaced in the same manner as described for the lifter and with the same ease and convenience.

Figure 5:
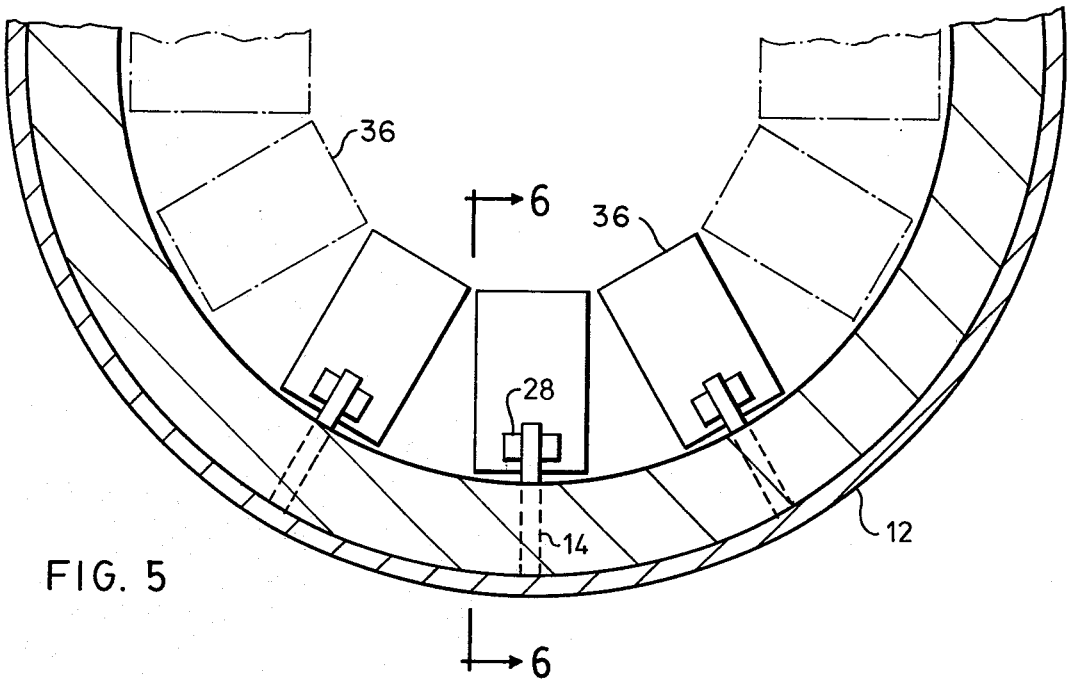
FIG. 5 shows the inventive mounting applied to a dam.
Figure 6:
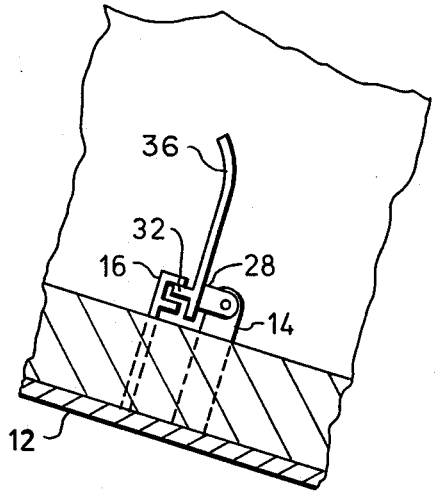
FIG. 6 is a side view of one of the devices of FIG. 5.

As an example of another device, FIGS. 5 and 6 show a plurality of devices 36 shaped like lifters but each having their convex sides facing downstream and the concave sides facing upstream. Each device 36 is provided with ears 28 on one side and a ridge 32 on the other and corresponding to each device are standards 14 and 16 mounted on the kiln walls and extending through the refractory, with standard 14 mounting an ear for alignment and 'pinning' to ears 28 and with standard 16 defining a groove to receive the ridge 32. The devices are located, facing upstream, having the general plane of the plates 36 approximately perpendicular to the axis of the kiln and arranged in a ring about the kiln to form a dam, which acts to set a predetermined level for material thereabove travelling down the kiln. While the divergent spaces between individual members 36 may be eliminated by special design of the members, the spaces shown, do not, in most applications, seriously interfere with the operation of the dam.

The dam, thus constructed, replaces a dam built of a ridge of bricks or poured refractory extending around the inside of the kiln wall. Such a brick or refractory dam is extremely weighty, sometimes requiring replacement of the drive and bearings for the kiln and expensive to repair and replace. Conversely the specially mounted metal dam of this invention is *comparatively* light and easy to replace.

The concave upwardly facing plates 32 supply on their convex downstream face a relatively streamline face for gas flowing thereover, upstream, through the kiln.

The invention may be used to mount other devices than lifters and dams.

I claim:

1. Means for mounting lifter surfaces in a kiln comprising:

a plurality of pairs of standards rigidly attached to the kiln wall and extending approximately radially inwardly therefrom through the refractory lining of the kiln into the material carrying portion thereof, standards of such pair being spaced from each other a short distance in the circumferential direction about said kiln, a lifter having a surface designed to extend lengthwise along said kiln, and to extend generally radially inwardly thereof, designed for lifting particulate material from a bed thereof in the lower portion of said kiln to allow it to return to the bed under gravity during travel of said lifter over the upper portion of its travel during the rotation of said kiln, one of said standards and said lifter being provided with cooperating ears having bores therein designed for alignment when said lifter is in place, a pin removably extending through the aligned bores in said lifter and said standard, the other of said standards and said lifter being provided with cooperating surfaces arranged, when said pin is connecting said lifter to said one standard, to prevent substantial rotation of said lifter about said pivot point, said standards and said lifter being so designed that said lifter may be removed from said standards, or applied thereto with said bores aligned, when said pin is removed from said bores.

2. Means for mounting a device in a kiln comprising:

a pair of standards rigidly attached to the kiln wall and extending approximately radially inwardly therefrom through the refractory lining of the kiln into the material carrying portion thereof, said standards being spaced from each other a short distance in the circumferential direction about said kiln, a device for mounting in said kiln, one of said standards and said device being provided with cooperating ears having bores therein designed for alignment when said device is in place, a pin removably extending through the aligned bores in said device and said standard, the other of said standards and said device being provided with cooperating surfaces arranged, when said pin is connecting said device to said one standard, to prevent substantial rotation of said device about said pivot point, said standards and said device being so designed that said device may be removed from said standards, or applied thereto with said bores aligned, when said pin is removed from said bores.

3. A dam constructed of a plurality of devices mounted as claimed in claim 2, such devices being formed of plates and arranged in a ring about the wall of the kiln, such plates having the general plane of their area perpendicular to the axis of the kiln.

* * * * *